US009262945B2

(12) United States Patent
Frey

(10) Patent No.: US 9,262,945 B2
(45) Date of Patent: Feb. 16, 2016

(54) CORNER TAB KIT AND SYSTEM FOR PORTABLE FABRIC PANEL DISPLAYS

(71) Applicant: MOSS HOLDING COMPANY, Elk Grove Village, IL (US)

(72) Inventor: Robert M. Frey, Salt Lake City, UT (US)

(73) Assignee: Moss Holding Company, Elk Grove Village, IL (US)

( * ) Notice: Subject to any disclaimer, the term of this patent is extended or adjusted under 35 U.S.C. 154(b) by 0 days.

(21) Appl. No.: 14/459,238

(22) Filed: Aug. 13, 2014

(65) Prior Publication Data

US 2015/0047235 A1 Feb. 19, 2015

Related U.S. Application Data

(60) Provisional application No. 61/865,315, filed on Aug. 13, 2013.

(51) Int. Cl.

| | |
|---|---|
| ***G09F 17/00*** | (2006.01) |
| ***G09F 5/00*** | (2006.01) |
| ***G09F 15/00*** | (2006.01) |

(52) U.S. Cl.

CPC *G09F 5/00* (2013.01); *G09F 15/00* (2013.01); *G09F 15/0012* (2013.01); *G09F 15/0025* (2013.01); *G09F 15/0056* (2013.01)

(58) Field of Classification Search

USPC ..... 40/603, 781; 38/102, 102.1, 102.2, 38/102.91; 160/378, 380, 381

See application file for complete search history.

(56) References Cited

U.S. PATENT DOCUMENTS

| | | | | |
|---|---|---|---|---|
| 2,784,781 | A * | 3/1957 | Rhoades | 160/371 |
| 4,762,076 | A * | 8/1988 | Wakaizumi | 112/103 |
| 5,113,611 | A * | 5/1992 | Rosson | 38/102.7 |
| 8,015,736 | B2 | 9/2011 | Frey | |
| 8,196,326 | B2 | 6/2012 | Frey | |
| 8,240,072 | B2 | 8/2012 | Frey | |
| 8,627,590 | B1 * | 1/2014 | Whitehead | 40/792 |
| 2010/0202827 | A1 | 8/2010 | Frey | |

* cited by examiner

*Primary Examiner* — Joanne Silbermann

(74) *Attorney, Agent, or Firm* — Lauce M. Pritikin, Esq.

(57) ABSTRACT

A panel element includes a fabric panel, a corner gasket element and two auxiliary gaskets. The corner gasket element has a tab member and two gasket legs. Each leg extends to respective outer ends from a common intersection in a manner orthogonal to one another. The tab member extends from the intersection in a manner orthogonal to the legs. The auxiliary gaskets each have at least one gasket end positioned adjacently to a respective outer end. The fabric panel has a display face and an outer perimeter portion. The outer perimeter portion is affixed to the gasket legs and the auxiliary gaskets. The gasket legs and auxiliary gasket elements are removably insertable into a perimeter groove disposed in the closed-contour framework, thereby facilitating tensioned attachment of the fabric panel across an opening defined by the closed contour with said tab member gripably protruding outward of the display face.

7 Claims, 3 Drawing Sheets

CORNER TAB KIT AND SYSTEM FOR PORTABLE FABRIC PANEL DISPLAYS

RELATED APPLICATIONS

This application claims the benefit of U.S. Provisional Application No. 61/865,315 filed Aug. 13, 2013, the content of which is incorporated by this reference in its entirety for all purposes as if fully set forth herein.

TECHNICAL FIELD

The present invention relates generally to portable display systems designed to form temporary structures to which fabric panels are removably attached, such as in the trade show and retail environments.

BACKGROUND

Portable fabric panel display wall systems are commonly used, for example, within the trade show industry. It is desirable for such systems to be visually appealing in their assembled configuration, and quickly and easily assembled and disassembled using common tools or by hand. In many conventional fabric display wall systems, the fabric panel includes linear gaskets which run along its perimeter, the gaskets being insertable into a lateral groove running along the outside edge of the framework. However, lack of continuity of the conventional linear gaskets at the panel corners often results in failure to keep the fabric aligned at the corner of the panel, which can produce unsightly gaps and puckers depending upon the skill of the panel installer. Moreover, repeated assembly and disassembly of the wall system often results in the corner fabric becoming damaged due to a lack of a convenient removal mechanism, and the relative lack of structural support for the fabric at the immediate corners of the fabric panel.

What is needed is a kit and system which replaces the standard gasket configuration at the corners of a fabric display so as to extend the useful life of the fabric panel by reducing fabric stress applied during disassembly, and to eliminate unsightly gaps and puckers in the corner fabric when the wall is in assembled configuration. This problem should be solved without presenting unsafe or unsightly features in the final assembled wall structure.

SUMMARY

Certain deficiencies of the prior art may be overcome by the provision of one or more embodiments of a corner tab kit and system for fabric panel displays.

An exemplary kit for constructing a portable display wall structure may comprise a panel element and at least four elongated frame elements configured to be assembled to form a closed contour framework.

The panel element includes a fabric panel, at least one corner gasket element and at least two auxiliary gasket elements. The corner gasket element has a tab member and a pair of gasket legs. Each of the legs extends to a respective leg outer end from a common intersection, preferably in a manner orthogonal to one another. The tab member preferably extends from the intersection in a manner orthogonal to the legs. The auxiliary gasket elements each have at least one gasket end positioned adjacently to a respective outer end. The fabric panel has a display face and an outer perimeter portion affixed to the gasket legs and auxiliary gasket elements.

The gasket legs and auxiliary gasket element are removably insertable into a perimeter groove disposed in the closed-contour framework, thereby facilitating the tensioned attachment of the fabric panel across the opening defined by the closed contour with the tab member gripably protruding outward of the display face. The tab member is largely unobtrusive to customers viewing the display wall, as it is relative small and may be molded of a clear polymer.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
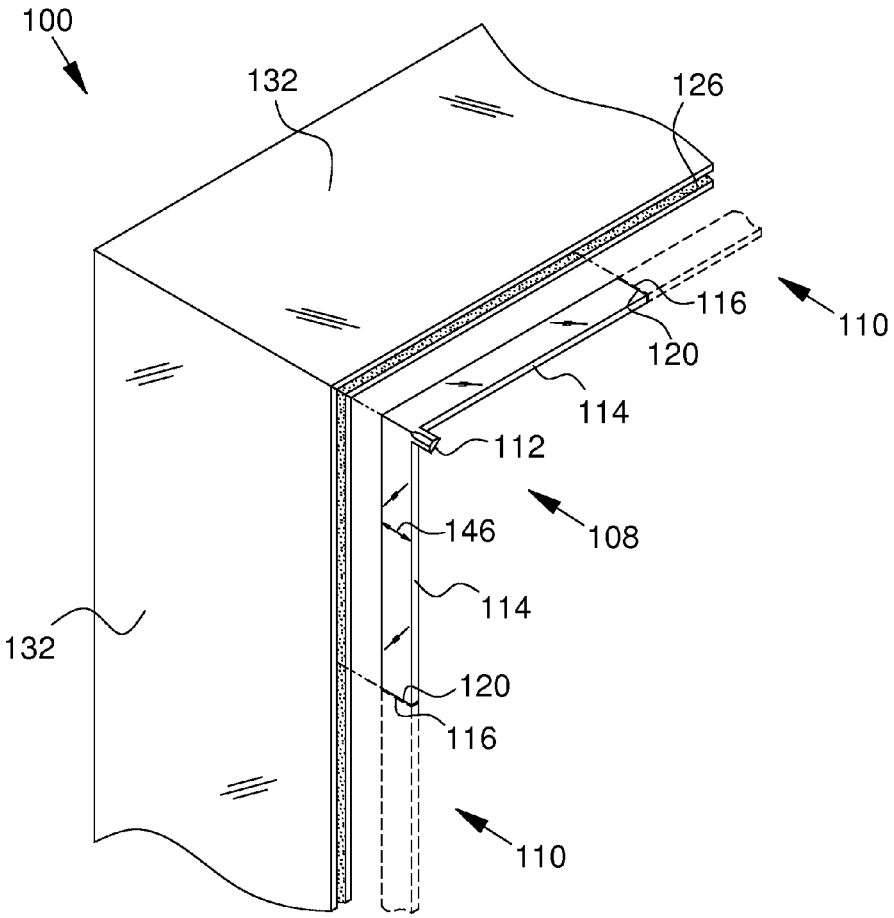
FIG. 1 is a diagrammatic partial perspective view of components of a kit in accordance with present invention.

Referring now to the drawings, like reference numerals designate identical or corresponding features throughout the several views.

Figure 2:
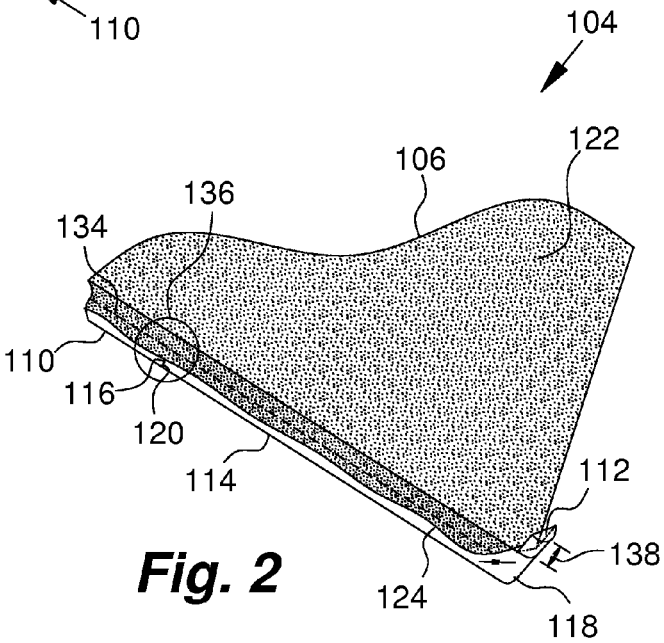
FIG. 2 is a diagrammatic partial perspective view of a panel element in accordance with an embodiment of the present invention.
Figure 3:
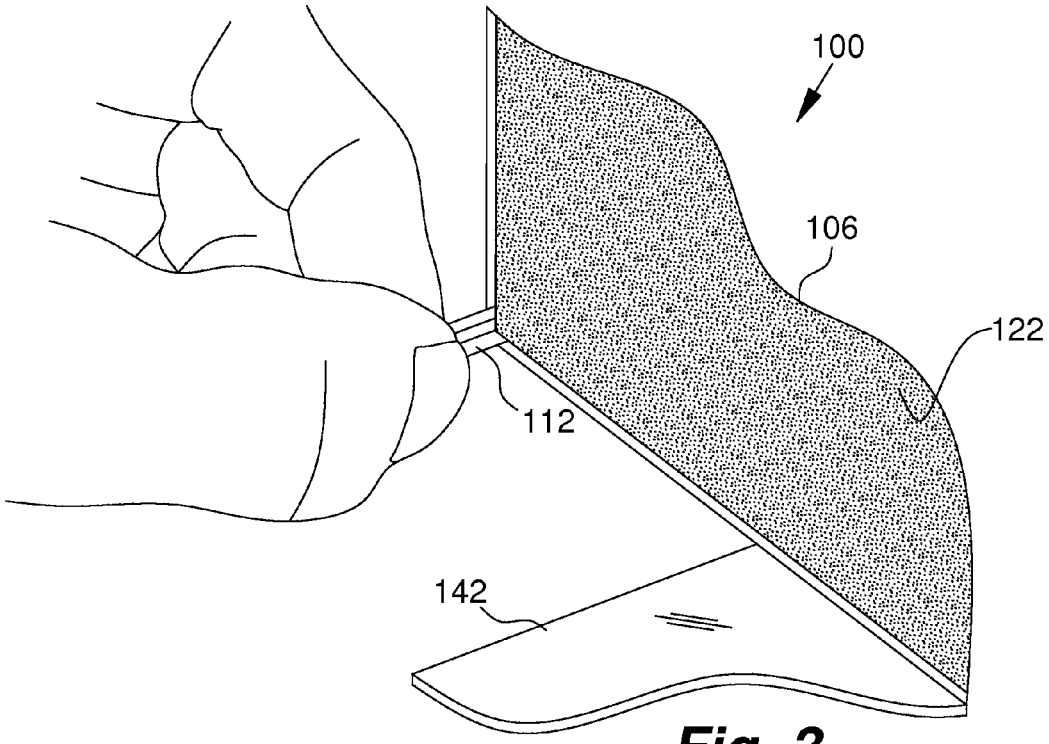
FIG. 3 is a diagrammatic partial perspective view of a user gripping the tab member of a panel element in preparation for pulling the panel gaskets out of the perimeter groove of the assembled framework.

Referring to FIGS. 1 and 2 for example, embodiments of a kit 100 for constructing a portable display wall structure 102 comprise at least a panel element 104. A panel element 104 may include a fabric panel 106, a corner gasket element 108, and at least two auxiliary gasket elements 110. The corner gasket element 108 may have a tab member 112 and first and second gasket legs 114. Each of the legs extends to a respective outer end 116 from a common intersection 118 in a manner orthogonal to one another, The tab member 112 may extend from the intersection 118 in a manner orthogonal to the legs 114. The auxiliary gasket elements 110 may each have at least one gasket end 120 positioned adjacently to a respective outer end 116 of a gasket leg 114. In particular embodiments, the term "positioned adjacently" means within a distance less than the width 146 of the gasket leg, but preferably abutting. The fabric panel 106 may have a display face 122 opposite an inner face (not shown), and an outer perimeter portion 124 affixed to the gasket legs 114 and auxiliary gasket elements 110. The display face 122 may preferably have display graphics printed thereon.

Referring to FIGS. 3-6 for example, in preferred embodiments, the gasket legs 114 and auxiliary gasket element 110 are removably insertable (e.g., via press-fit) into a perimeter groove 126 disposed in a closed-contour framework 128, thereby facilitating the tensioned attachment and securement of the fabric panel 106 across the opening 130 defined by the closed contour 128 with the tab member 112 gripably protruding outward of the display face 122. In particular embodiments, each gasket leg may be at least 100 mm in length. In other embodiments, the legs may be shorter.

Certain preferred embodiments of a kit in accordance with the present invention may further comprise at least four elongated frame elements 132 configured to be reversibly assembled (i.e., capable of being rapidly disassembled) to form the closed contour framework 128.

Figure 7:
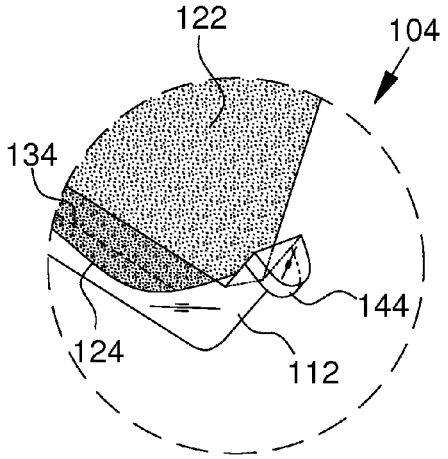
FIG. 7 is a diagrammatic partial view of a further embodiment a panel element, wherein the tab member includes a lip member extending laterally thereof.

In particular preferred embodiments of the kit and system described herein, the corner gasket element 108 may be formed of a transparent polymer. Moreover, the corner gasket element 108 may be elastically bendable. Referring to FIG. 7 for one non-limiting embodiment, the tab element 112 may include a lip member 144 extending laterally thereof, thereby helping a user secure their grip of the table member. With reference to FIG. 2, the tab member may be less than one inch in length, the length 138 preferably being defined by the distance the tab member 112 projects outward of the fabric panel 106.

In certain preferred embodiments, the perimeter groove 126 may be continuous when the closed contour framework is assembled. Further, with reference to FIG. 5, the closed contour framework 128 may include a multiplicity of right-angle corners 140, and the panel element 104 may include a corner gasket element 108 corresponding to each of the corners 140.

Referring to FIG. 2 for example, in particular embodiments, the outer perimeter portion 124 may be affixed to the gasket legs 114 and auxiliary gasket elements 110 by way of at least one line of stitching 134. Moreover, a reinforcement tack stitch may preferably be placed through the fabric panel 106, gasket leg 114 and auxiliary gasket element 110 at each position 136 where a respective outer end 116 is adjacent to a respective gasket end 120.

Figure 4:
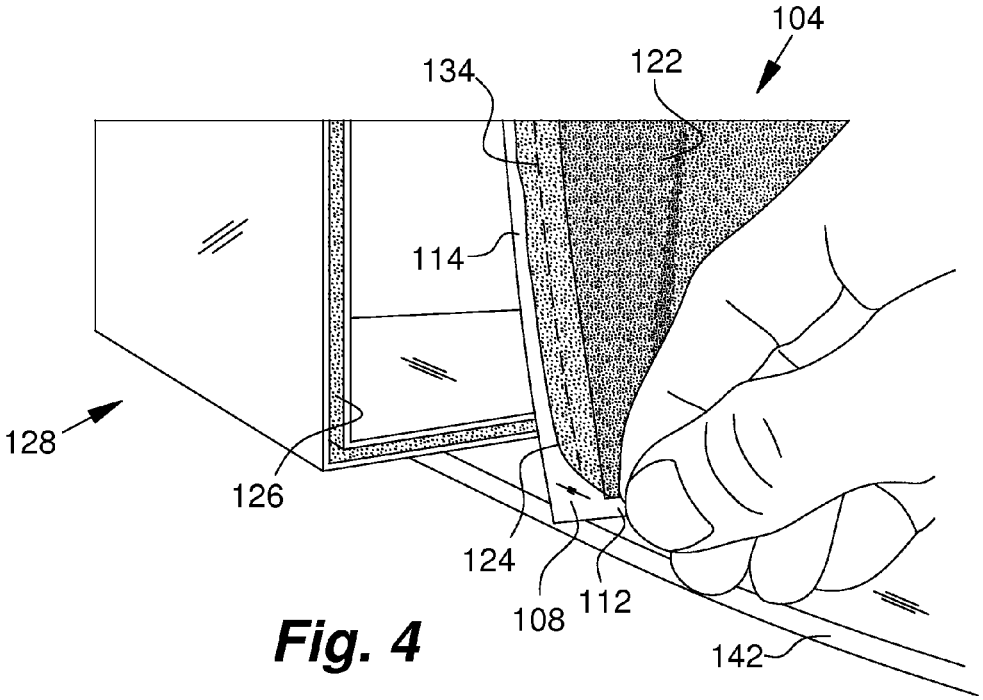
FIG. 4 is a diagrammatic partial perspective view of a step subsequent to that of FIG. 3, showing the tab member having been gripped and pulled by the user to remove the panel element from the framework.
Figure 5:
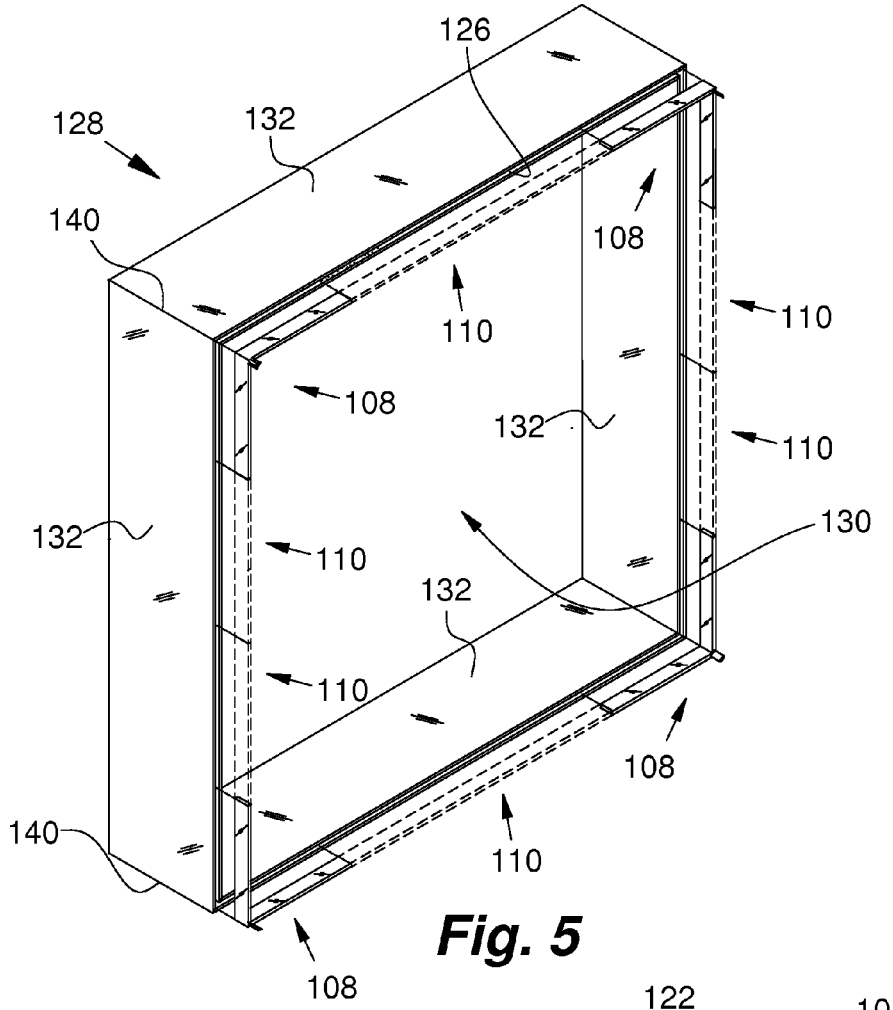
FIG. 5 is a diagrammatic perspective view of components of a kit and system in accordance with certain embodiments of the present invention, showing the closed contour framework assembled from four elongated frame elements, and resulting in a continuous perimeter groove.
Figure 6:
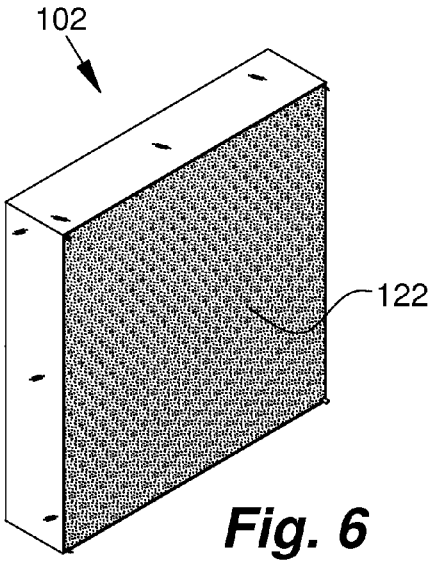
FIG. 6 is a diagrammatic perspective view of a completely assembled structure and system in accordance with one embodiment of the present invention, illustrating the tensioned attachment and securement of the fabric panel across the opening defined by the closed contour framework.

Referring to FIGS. 4-6 for example, a portable display wall system 102 may comprise a panel element 104 and at least four elongated frame elements 132 reversibly assembled to form a closed contour framework 124. The gasket legs 114 and auxiliary gasket elements may be removably snuggly inserted into a perimeter groove 126 disposed in the closed-contour framework 128, thereby facilitating the tensioned attachment of the fabric panel 106 across the opening 130 defined by the closed contour with the tab member 112 gripably protruding outward of the display face 122. One or more foot elements 142 may be provided to stabilize the assembled system 102 on a supporting surface.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A portable display wall system comprising:

at least four elongated frame elements reversibly assembled to form a closed contour framework;

a panel element including a fabric panel, a corner gasket element, and two auxiliary gasket elements, said corner gasket element having a tab member and first and second gasket legs, each of said legs extending to a respective outer end from a common intersection in a manner orthogonal to one another, said tab member extending from said intersection a manner orthogonal to said legs, said auxiliary gasket elements each having a gasket end positioned adjacently to a respective said outer end, said fabric panel having a display face and an outer perimeter portion affixed to said gasket legs and said auxiliary gasket elements;

said gasket legs and said auxiliary gasket elements being removably snuggly inserted into a perimeter groove disposed in said closed-contour framework, thereby facilitating tensioned attachment of said fabric panel across an opening defined by said closed contour with the tab member gripably protruding outward of said display face.

2. The system defined in claim 1 wherein said closed contour includes a multiplicity of right-angle corners, and said panel element includes a said corner gasket element corresponding to each said corner.

3. The system defined in claim 1 wherein said corner gasket element is formed of a transparent polymer.

4. The system defined in claim 1 wherein said tab member includes a lip member extending laterally thereof.

5. The system defined in claim 1 wherein a reinforcement tack stitch is placed through the fabric panel, gasket leg and auxiliary gasket element at each position where a respective said outer end is adjacent a respective said gasket end.

6. The system defined in claim 1 wherein each said leg is at least 100 mm in length.

7. The system defined in claim 1 wherein said corner gasket element is elastically bendable.

* * * * *